US005809740A

United States Patent [19]

Sundby et al.

[11] Patent Number: 5,809,740

[45] Date of Patent: Sep. 22, 1998

[54] ULTRAVIOLET ASSEMBLY FOR USE IN IRRADIATING CONTAINERS IN A PACKAGING MACHINE

[75] Inventors: Paul C. Sundby, Mahtomedi; Kenneth M. Eno, Burnsville; John L. Cicha, Shoreview, all of Minn.

[73] Assignee: Tetra Laval Holdings & Finance, SA, Pully, Switzerland

[21] Appl. No.: 828,927

[22] Filed: Mar. 28, 1997

[51] Int. Cl.[6] ..... B65B 55/04

[52] U.S. Cl. ..... 53/167; 53/426

[58] Field of Search ..... 53/77, 167, 425, 53/426; 250/455.11; 422/24

[56] References Cited

U.S. PATENT DOCUMENTS

| | | |
|---|---|---|
| 2,095,502 | 10/1937 | Johnston . |
| 3,826,014 | 7/1974 | Helding . |
| 3,894,343 | 7/1975 | Pray et al. . |
| 4,005,135 | 1/1977 | Helding . |
| 4,037,112 | 7/1977 | Ramler et al. . |
| 4,056,921 | 11/1977 | Gilliand et al. . |
| 4,182,047 | 1/1980 | Currie . |
| 4,375,145 | 3/1983 | Mosse et al. . |
| 4,448,750 | 5/1984 | Fuesting . |
| 4,579,614 | 4/1986 | Burmeister et al. . |
| 4,776,267 | 10/1988 | Harris . |
| 4,877,964 | 10/1989 | Tanaka et al. . |
| 4,944,132 | 7/1990 | Carlsson et al. . |
| 5,069,017 | 12/1991 | Fabricius . |
| 5,124,212 | 6/1992 | Lee et al. . |
| 5,129,212 | 7/1992 | Duffey et al. . |
| 5,326,542 | 7/1994 | Sizer et al. . |
| 5,368,828 | 11/1994 | Carlson . |
| 5,433,920 | 7/1995 | Sizer et al. . |
| 5,446,289 | 8/1995 | Shodeen et al. . |
| 5,475,969 | 12/1995 | Sowden . |
| 5,597,597 | 1/1997 | Newman . |

*Primary Examiner*—Daniel B. Moon
*Attorney, Agent, or Firm*—Michael A. Catania

[57] ABSTRACT

A sterilization system for sterilizing surface areas of a packaging material in a packaging machine is set forth. The sterilization system comprises an ultraviolet lamp including a housing and an ultraviolet light transmission portion. A support assembly is connected to support the ultraviolet lamp. The ultraviolet lamp is connected to the support assembly so that it is pivotable with respect to the support assembly from a first operating position in which the ultraviolet transmission portion of the ultraviolet lamp is disposed to irradiate the surface areas of the packaging material and a second position in which the ultraviolet transmission portion of the ultraviolet lamp is disposed at an angle for cleaning or service. A latching mechanism may be used to secure the ultraviolet lamp in the second cleaning position. Alternatively, the ultraviolet lamp assembly may be automatically moved between the first and second positions using an automatic drive. In accordance with a still further enhancement of the apparatus, a linear drive mechanism may be used to drive the ultraviolet lamp, including at least a portion of the support assembly, between a raised and lowered position. Such movement of the ultraviolet lamp facilitates easy access for cleaning and service.

1 Claim, 4 Drawing Sheets

ULTRAVIOLET ASSEMBLY FOR USE IN IRRADIATING CONTAINERS IN A PACKAGING MACHINE

BACKGROUND OF THE INVENTION

The present invention relates to an ultra-violet lamp assembly for use in irradiating packaging material in a form-fill-seal packaging machine. More particularly, the present invention relates to an ultra-violet lamp assembly for use in irradiating packaging material in a packaging machine wherein the ultraviolet lamp and its associated components are readily subject to cleaning or service.

Milk or juice is often packaged in cartons that have been sterilized to prolong the shelf life of the contents under refrigeration. When milk or juice is packaged under aseptic packaging conditions, the content are capable of being stored for a substantial period of time at room temperature without spoilage. Both of these packaging processes require effective sterilization of the packaging material prior to filling of a container formed from the packaging material. For example, a container, such as a gable-top container, that has previously been formed may have its interior surfaces sterilized prior to being filled with product. U.S. Pat. No. 4,375,145, discloses a packaging machine having a conveyor on which pre-formed cartons advance under ultraviolet germicidal lamps to expose the interior of the cartons to ultraviolet radiation. In addition, the interior of the cartons may be sprayed with a carousel germicidal solution, such as hydrogen peroxide, passing under the ultraviolet lamps.

U.S. Pat. No. 4,289,728, discloses a method for sterilization of the surfaces of food containers and other materials by applying a hydrogen peroxide solution, followed by ultraviolet radiation. This patent indicates that the peak intensity of ultraviolet radiation occurs at a wavelength of 254 nm. The concentration of the hydrogen peroxide solution is less than 10% by weight, and furthermore, the hydrogen peroxide solution is heated during or subsequent to irradiation.

UV sterilization has been shown to be suitable for sterilization of flat films but has been found to have limited applicability to preformed, angular containers (Maunder, 1977) due to the geometric and physical constraints associated with UV light. If a simple UV lamp is placed in close proximity above a preformed container, such as a gable top carton, the sterilization effectiveness is severely limited due to several reasons. The total light flux entering the carton is restricted to light that can be directed through the carton opening, which in the case of typical gable top cartons are 55×55 mm, 70×70 mm or 95×95 mm. Unreflected light emitted from a line source UV lamp decreases in intensity with the square of the distance from the light source. Thus, as the depth of the carton increases, the light intensity falls off.

Another problem in sterilizing these cartons with UV light is that the light enters the top of the carton and radiates toward the bottom substantially parallel to the sides of the carton. The germicidal effect of the light that impinges on the sides is very low because of the high angle of incidence. Thus, the sides of the cartons are the most difficult surfaces to sterilize, especially for tall cartons. When the cartons are positioned on the conveyor, two sides of the carton lie in a plane that is parallel to the axis of the lamp, while the other two sides are transverse to the axis of the lamp. Since the lamp is elongated, radiation impinges on the transverse sides of the carton at a higher angle of incidence than it does on the parallel sides of the carton. In the case of a single UV lamp source above the center of a 70×70×250 mm rectangular carton, the effective light intensity at the bottom of the carton would be reduced to 13.9% of the maximum intensity at that distance from the source. The carton sides transverse to the lamp axis receive light from the entire length of the bulb. Light originating from the lamp reflector on the side opposite the parallel carton wall will have a minimum incident angle and thus have an intensity equal to 27.0% of the lamp intensity.

One ultraviolet lamp assembly that is designed to address, among other things, the problem of effective irradiation of pre-formed packages is disclosed in U.S. Pat. No. 5,433,920, to Sizer et al. In accordance with one aspect of the invention disclosed therein, an ultraviolet reflector for use with an ultraviolet lamp is utilized to effectively irradiate the sides as well as the bottom of the container.

The foregoing apparatus and methods do not properly address the cleaning or service of the ultraviolet lamp assemblies within the machine. Cleaning or service of the ultraviolet lamp assembly is required to assure the sterility of the overall form-fill-seal process of a packaging machine and proper operation of the sterilization system. Such cleaning and service, however, can be quite time and labor intensive since it may often require complete removal of the lamp assembly.

BRIEF SUMMARY OF THE INVENTION

A sterilization system for sterilizing surface areas of a packaging material in a packaging machine is set forth. The sterilization system comprises an ultraviolet lamp including a housing and an ultraviolet light transmission portion. A support assembly is connected to support the ultraviolet lamp. The ultraviolet lamp is connected to the support assembly so that it is pivotable with respect to the support assembly from a first operating position in which the ultraviolet transmission portion of the ultraviolet lamp is disposed to irradiate the surface areas of the packaging material and a second position in which the ultraviolet transmission portion of the ultraviolet lamp is disposed at an angle for cleaning or service. A latching mechanism may be used to secure the ultraviolet lamp in the second cleaning position. Alternatively, the ultraviolet lamp assembly may be automatically moved between the first and second positions using an automatic drive. In accordance with a still further enhancement of the apparatus, a linear drive mechanism may be used to drive the ultraviolet lamp, including at least a portion of the support assembly, between a raised and lowered position. Such movement of the ultraviolet lamp facilitates easy access for cleaning and service.

DETAILED DESCRIPTION OF THE INVENTION

Figure 1:
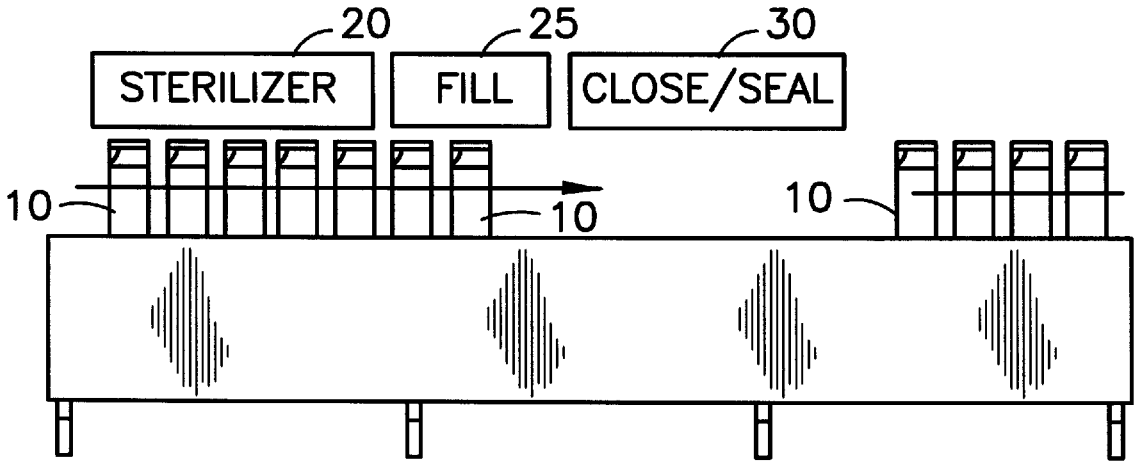
FIG. 1 is a schematic block diagram of a portion of a basic packaging machine.

A common form of container for milk and juice is known as the gable-top container. The container has a paperboard substrate with a plastic coating on the inside and outside which enables the top of the carton to be closed and sealed in the shape of a gable top. Referring to FIG. 1, the cartons 10 typically have a square bottom which is heat sealed and placed on a conveyor which advances stepwise to the right as viewed in FIG. 1. The cartons 10 are placed equidistant from each other and the cartons advance a predetermined number of carton positions during each periodic advancing step of the conveyor. Between each advancing step, the cartons generally remain stationary for processing.

As illustrated in FIG. 1, the cartons pass through a sterilization system 20 which exposes the sides and bottom of the interior of the cartons 10 to ultraviolet light. At a subsequent station, the cartons are filled by a filling mechanism 25. The cartons then pass through a subsequent closing and sealing station 30 where the top of the carton is closed.

Figure 2:
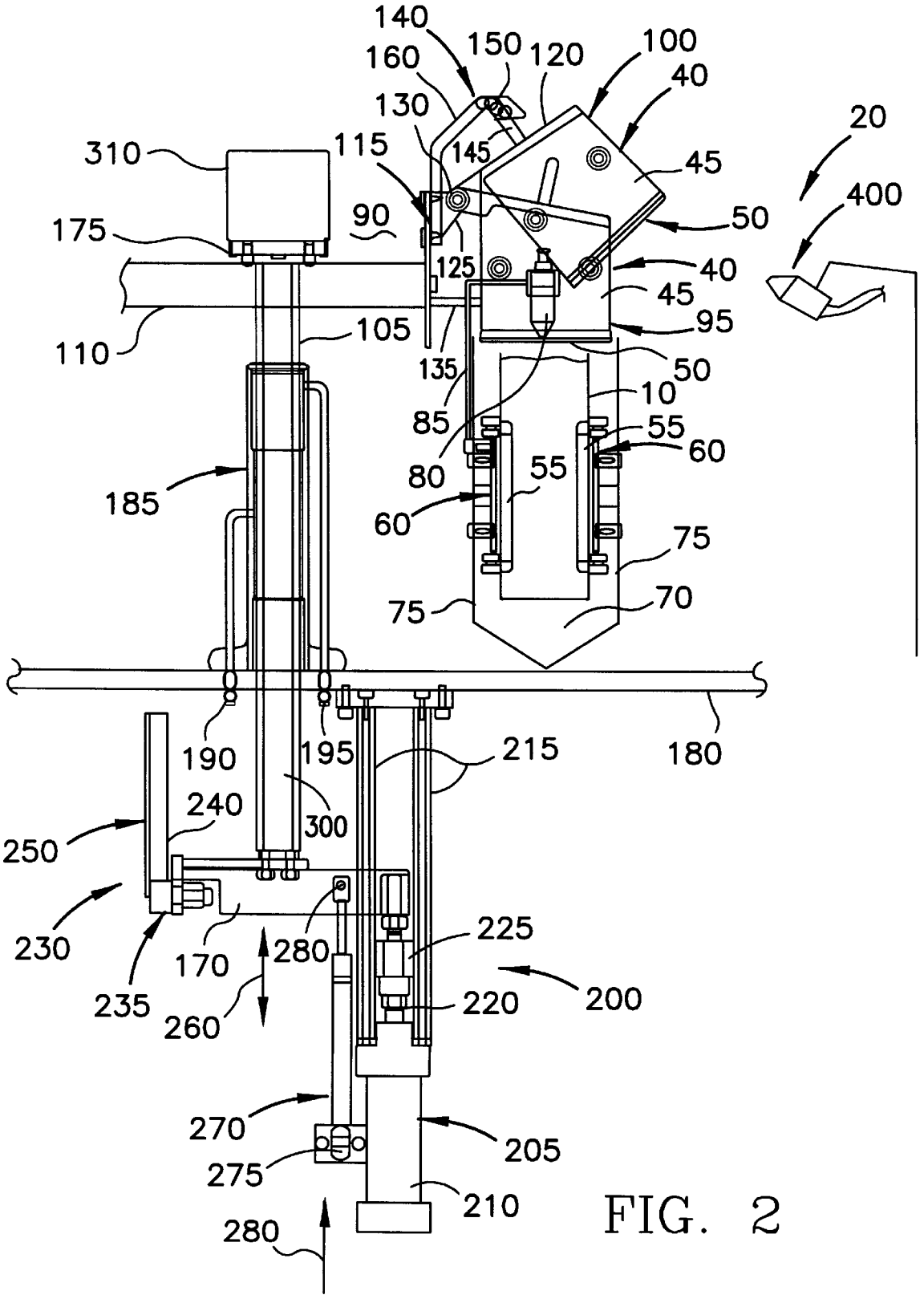
FIG. 2 is an illustration of one embodiment of a sterilizer system in which the ultraviolet lamp assembly is disposed in a lowered position.

One embodiment of a sterilization system is shown generally at 20 of FIG. 2. The sterilization system 20 of the illustrated embodiment is disposed for use in a form-fill-seal packaging machine, such as a TR/6™, TR/7™, or the like which forms, fills, and seals a container, such as a gable-top carton 10. It will be recognized, however, that the sterilization system 20 may be incorporated in a packaging machine that fills other container types, the present system being illustrative.

As shown, the sterilization system 20 comprises an ultraviolet lamp assembly 40. The ultraviolet lamp assembly 40 comprises a housing 45 having an ultraviolet transmission region 50 disposed therein. One such ultraviolet lamp is disclosed in U.S. Pat. No. 5,433,920, which is hereby incorporated by reference.

The ultraviolet transmission region 50 of the ultraviolet lamp assembly 40 is disposed to irradiate the interior of the partially-formed carton 10 that is transported in an indexed matter between various stations of the packaging machine by, for example, a carton carrier 55 disposed on an endless conveyor 60. Preferably, the carton 10 is irradiated when it enters a reflection tunnel 70 defined by reflectors 75 disposed on either side of the container path. In FIG. 2, the container path is directed into the drawing.

The interior surfaces of the carton 10 are preferably sprayed with a germicidal solution, such as a hydrogen peroxide solution, prior to or concurrently with its irradiation with ultraviolet light by the ultraviolet lamp assembly 40. In the disclosed embodiment, a hydrogen peroxide solution is sprayed into the interior of the carton 10 using a sprayer 80 that is supported by a support arm 85 so that the sprayer 80 overlies the container path. The interior surfaces of the carton 10 are sprayed with the hydrogen peroxide solution before being irradiated by the ultraviolet lamp assembly 40.

During a production cycle of the packaging machine, contaminants may build up on various machine components, including the ultraviolet lamp assembly 40. Contaminants disposed at the ultraviolet transmission region 50 of the ultraviolet lamp assembly 40 are particularly troublesome in view of the fact that the transmission region 50 directly overlies the container path and, as such, may introduce the contaminants directly into the interior of the carton 10. Accordingly, the ultraviolet lamp assembly 40 is subject to periodic cleaning with other components of the packaging machine.

The present inventors have recognized that the cleaning process associated with the ultraviolet lamp assembly 40 has conventionally been both time and labor intensive. As shown in FIG. 2, the ultraviolet transmission region 50 is disposed in the tunnel 70 and is not subject to easy access. Cleaning of the ultraviolet lamp assembly 40, including the ultraviolet transmission region 50, often involves a manual removal of the heavy and bulky ultraviolet lamp assembly 40 followed by a manual cleaning thereof. Service of the ultraviolet lamp assembly 40, likewise, often involves such manual removal.

In contrast to the conventional supports used to support the ultraviolet lamp assembly 40 in its operative position during a production cycle of the packaging machine, the sterilization system 20 of the disclosed embodiment employs a unique support arrangement that facilitates fast and easy cleaning of the ultraviolet lamp assembly 40, including the ultraviolet transmission region 50. As shown in FIG. 2, the ultraviolet lamp assembly 40 is connected to a unique support assembly, shown generally at 90, so that it may pivot between a first position 95 in which the ultraviolet transmission region 50 overlies the container path for a production cycle of the packaging machine and a second position 100 in which the ultraviolet transmission region 50 is exposed for a cleaning or service operation. In the illustrated embodiment, the support assembly 90 comprises a vertically oriented support shaft 105 that is connected to a transverse support 110. The transverse support 110 is connected to a bracket 115 to which the housing 45 of the ultraviolet lamp assembly 40 is pivotally connected. More particularly, the housing 45 is connected to a housing bracket 120 that extends to engage support plates 125 (only one shown) extending from the bracket 115 at a pivot connection 130.

The ultraviolet lamp assembly 140 is inhibited from being over-extended from its first position 95 by a stop pin 135. Additionally, the ultraviolet lamp assembly 40 may be held in its second position 100 by a latching mechanism 140 that maintains the ultraviolet lamp assembly 40 in the second position 100. In the illustrated embodiment, the latching mechanism 140 comprises a handle 145 in fixed alignment with the ultraviolet lamp assembly 40 that engages a corresponding hook 150 that is in fixed alignment with the support assembly 90. More particularly, the handle 145 may extend directly from the housing 45 while the hook 150 may extend from a support arm 160 that extends from bracket 115.

In accordance with one embodiment of the sterilization system 20, the support assembly 90 may be used to support two ultraviolet lamp assemblies disposed at opposite ends of the transverse support 110. Each one of the to ultraviolet lamp assemblies may be respectively associated with a corresponding conveyor path, such as is found in dual-line packaging machines. In such instances, a mirror image of the components disposed at the right-hand side of the transverse support 110 may be found at the left-hand side of the transverse support 110.

Figure 3:
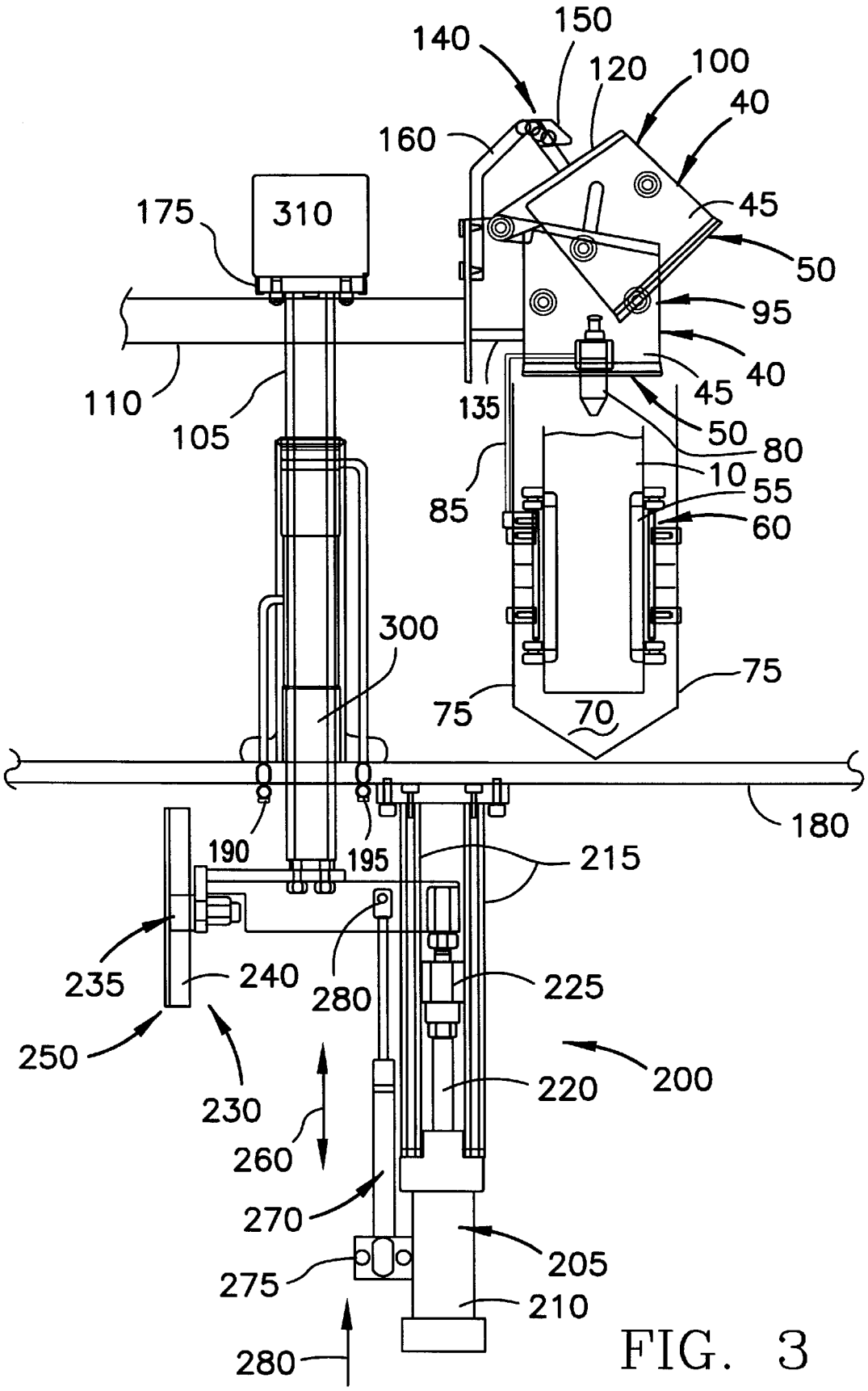
FIG. 3 is an illustration of the embodiment of the sterilizer system of FIG. 2 in which the ultraviolet lamp assembly is disposed in a raised position.
Figure 4:
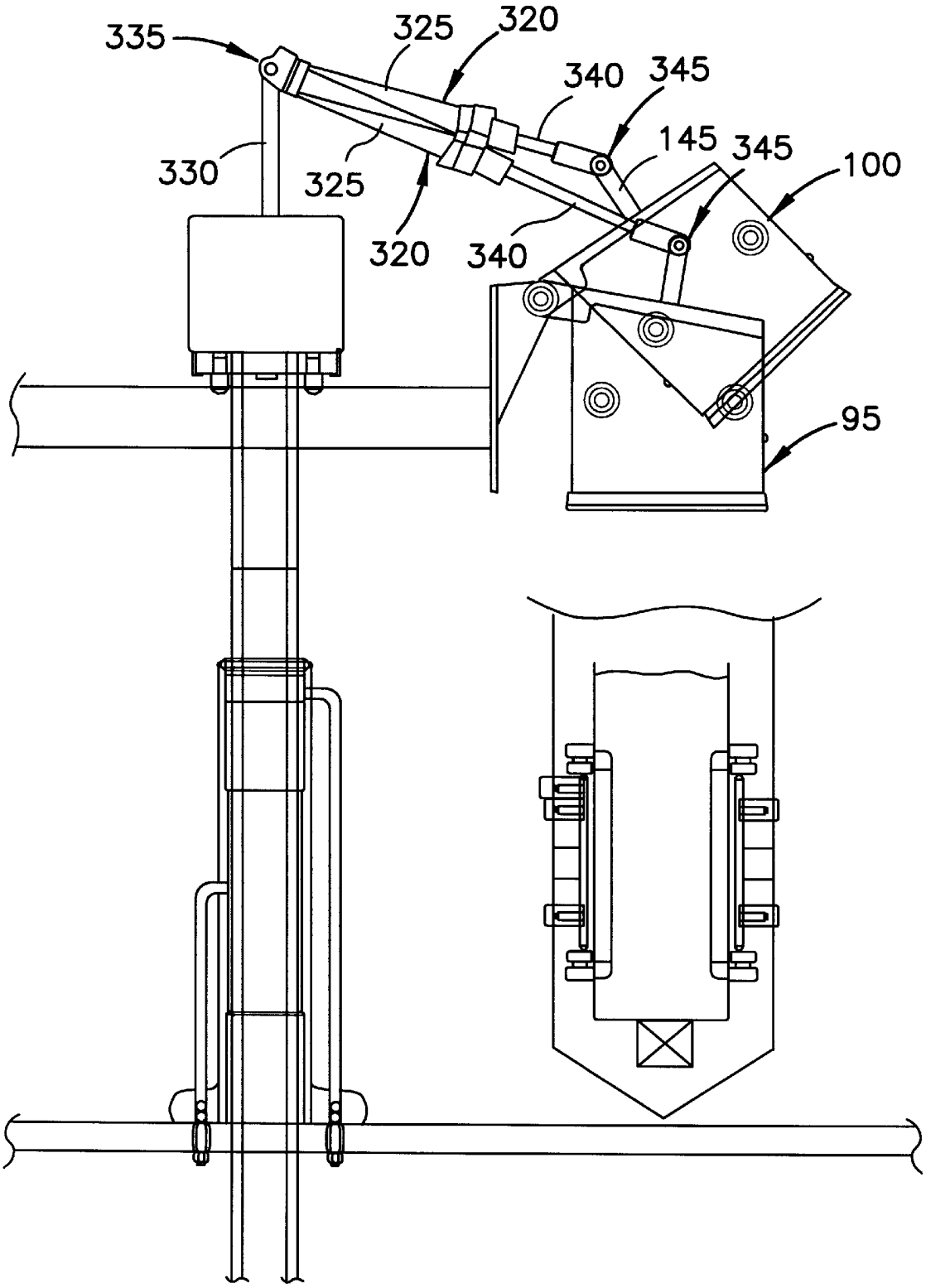
FIG. 4 is an illustration of a further embodiment of a sterilizer system in which the ultraviolet lamp assembly is pivoted between its first and second positions using an automatic drive.

In accordance with a further enhancement of the support assembly 90, the vertically oriented support 105 may be vertically movable between a first lowered position, shown in FIG. 2, and a second raised position, shown in FIG. 3. Movement of the support 105 between the first and second positions results in a corresponding movement of the ultraviolet lamp assembly 40 between a lower position proximate the tunnel 70 and an upper position distal the tunnel 70. Such vertical movement further facilitates easy access of the ultraviolet lamp assembly 40 including the ultraviolet transmission region 50 for cleaning and service.

As illustrated, the vertically oriented support 105 of the disclosed embodiment is connected at a lower end thereof to a transverse bracket 170 and at an upper end thereof to an intermediate bracket 175 extending between the support 105 and support 110. In the region above the table surface 180 of the packaging machine, the vertically oriented support 105 extends through a bushing 185. The bushing 185 is preferably lubricated by a lubricating fluid, such as biocidal lubricant, that is circulated through the interstitial regions between the interior portion of the bushing 185 and the exterior of the support rod 105. Preferably, the lubricating fluid is supplied at an inlet 190 and exits at an outlet 195 in a continuous manner.

The transverse bracket 170 of the disclosed embodiment forms part of a linear drive mechanism 200. The linear drive mechanism 200 comprises a air cylinder 205 having a housing 210 that, for example, is fixed to the table 180 by one or more connecting rods 215. The air cylinder 210 also comprises a piston rod 220 that is connected to the transverse bracket 170 through an extender coupling 225. The end of the transverse bracket 170 opposite the air cylinder 205 engages a guide assembly 230 that is comprised of a roller 235 that engages a channel 240 of a guide member 250 that is in fixed alignment within the packaging machine. The guide assembly 230 assists in preventing rotational movement of the support rod 105 about axis 260.

The linear drive mechanism 200 may also include a spring damper 270 that has a first end 275 in fixed engagement with the frame of the packaging machine and that has a second end 280 in fixed engagement with the transverse bracket 170. The spring damper 270 provides a constant force in the direction of arrow 280 to prevent the weight of the ultraviolet lamp assembly 40 and various support components from being driven downward too quickly thereby decreasing the likelihood of the occurrence of damage to the sterilization system 20 and increasing the safety thereof.

It will be recognized that other linear drive mechanism configurations may be used to drive the support rod 105 between the upper and lower positions. For example, the support rod 105 may be driven directly by another form of linear drive, such as a servo motor, or the like. Additionally, the support rod 105 may be driven directly without an intermediate transverse support such as transverse bracket 170. Other drive configurations are thus suitable for use in the sterilizing apparatus 20.

The linear drive mechanism 200 may be actuated in response to a programmable logic controller, or the like, which is used to control operation of the packaging machine. Such actuation may occur, for example, in response to manual actuation of a switch by a machine operator.

The ultraviolet lamp assembly 40 may require a plurality of electrical and pneumatic connections for proper operation. To this end, the support rod 105 may be hollow and define a tube channel 300 through a central portion thereof. Pneumatic, coolant, etc., tubes may extend through the channel 300 and into a connector housing 310 where tubes extending from the ultraviolet lamp assembly 40 may engage corresponding connectors of tubes extending through the channel 300. Although connector housing 310 is not absolutely required, it provides a degree of protection to the connection points between the tubes.

FIG. 3 illustrates a fully automatic version of the sterilization system 20. In the embodiment of FIG. 3, the ultraviolet lamp assembly 40 is pivoted automatically, without manual manipulation, between the first and second positions through operation of one or more air cylinders 320. As shown, an air cylinder 320 has its body portion 325 connected to a vertically extending support rod 330 at a first pivot joint 335 and its piston rod 340 connected to handle 145 at a second pivot joint 345.

The unique support configuration for the ultraviolet lamp assembly 40 described above facilitates access to the ultraviolet transmission portion 50 thereof. The portion 50 is thus easily accessed for cleaning and/or service. By having the portion 50 disposed at the illustrated angle while in the second position 100, it is also readily subject to automatic cleaning by a cleaning fluid sprayer, such as at 400 that directs a spray of cleaning fluid toward the surfaces of the ultraviolet transmission portion 50.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

We claim:

1. A form, fill and seal packaging machine for processing a series of cartons, the carton transported on a conveyor along a linear carton path, each of the cartons having an open top end, a sealed bottom end and a plurality of sidewalls extending from the bottom end to the open top end which define the exterior of each of the cartons, the packaging machine comprising:

a hydrogen peroxide sprayer for spraying hydrogen peroxide into the interior of each of the cartons and on the exterior of each of the cartons as each cartons enters the sterilization station;

a cleaning fluid sprayer disposed to spray a cleaning fluid during a cleaning cycle of the packaging machine;

an ultraviolet irradiation tunnel disposed downline from the hydrogen peroxide sprayer, the ultraviolet irradiation tunnel encompassing a section of the carton path and having an ingress end for each carton to enter the ultraviolet irradiation tunnel and an egress end for each carton to exit, the ultraviolet irradiation tunnel comprising an ultraviolet lamp assembly disposed above the carton path, the ultraviolet lamp assembly having an ultraviolet lamp, a hood, a reflector about the lamp, a transmission portion, and a support assembly, the support assembly allowing for the pivoting of the ultraviolet lamp assembly from a first position wherein the transmission portion is disposed to irradiate the interior and exterior of each of the cartons with ultraviolet energy as each carton enters the ultraviolet irradiation station, to a second position wherein the transmission portion is disposed at an angle to receive the cleaning fluid from the cleaning fluid sprayer during the cleaning cycle, a first side reflector disposed to one side of the carton path, the first side reflector substantially at a right angle with the ultraviolet lamp assembly when the ultraviolet lamp assembly is in the first position, a second side reflector disposed on the opposite side of the carton path from the first side reflector, the second side reflector substantially at a right angle with the ultraviolet lamp assembly when the ultraviolet lamp assembly is in the first position.

* * * * *